US011184712B2

(12) United States Patent
Bushko

(10) Patent No.: US 11,184,712 B2
(45) Date of Patent: Nov. 23, 2021

(54) DUAL-FIELD SINGLE-VOICE-COIL TRANSDUCER

(71) Applicant: Bose Corporation, Framingham, MA (US)

(72) Inventor: Dariusz Antoni Bushko, Hopkinton, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 16/775,512

(22) Filed: Jan. 29, 2020

(65) Prior Publication Data

US 2020/0169814 A1 May 28, 2020

Related U.S. Application Data

(63) Continuation-in-part of application No. 16/679,467, filed on Nov. 11, 2019, now abandoned, which is a (Continued)

(51) Int. Cl.

| | |
|---|---|
| ***H04R 9/02*** | (2006.01) |
| ***H04R 7/16*** | (2006.01) |
| ***H04R 1/00*** | (2006.01) |
| ***H04R 7/18*** | (2006.01) |
| *H04R 7/04* | (2006.01) |

(52) U.S. Cl.

CPC ..... *H04R 9/025* (2013.01); *H04R 7/18* (2013.01); *H04R 7/04* (2013.01); *H04R 2307/201* (2013.01)

(58) Field of Classification Search

CPC . H04R 1/00; H04R 1/02; H04R 1/026; H04R 7/04; H04R 7/12; H04R 7/16; H04R 7/18; H04R 7/20; H04R 9/025; H04R 9/04; H04R 9/043; H04R 9/06; H04R 9/063; H04R 2307/201; H04R 2307/025; H04R 2307/027; H04R 2209/041

See application file for complete search history.

(56) References Cited

U.S. PATENT DOCUMENTS

| | | | |
|---|---|---|---|
| 2,069,242 | A | 2/1937 | Graham |
| 2,439,666 | A | 4/1948 | Marquis |

(Continued)

FOREIGN PATENT DOCUMENTS

| | | | |
|---|---|---|---|
| JP | 2568241 | Y2 | 4/1998 |
| JP | H1155785 | A | 2/1999 |

(Continued)

*Primary Examiner* — Thang V Tran

(74) *Attorney, Agent, or Firm* — Hoffman Warnick LLC

(57) ABSTRACT

Various implementations include loudspeaker transducers. In some aspects, an electro-acoustic transducer includes: a diaphragm configured to move along an axis; a voice coil having a plurality of windings around the axis; a voice coil support configured to transfer forces from the voice coil to the diaphragm; a support structure that inhibits radial motion or tilting motion of the diaphragm and the voice coil support; and a magnetic core for driving the voice coil, the magnetic core including: two magnets having opposite polarity and approximately equal magnetic strength, where each of the magnets surrounds the voice coil, where a magnetic field from each magnet is approximately symmetric along the axis, and where the magnetic field from both magnets drives the voice coil.

20 Claims, 15 Drawing Sheets

Related U.S. Application Data continuation of application No. 14/716,126, filed on May 19, 2015, now Pat. No. 10,499,158.

(56) References Cited

U.S. PATENT DOCUMENTS

| | | | | |
|---|---|---|---|---|
| 3,019,849 | A | 2/1962 | King | |
| 3,134,057 | A | 5/1964 | Tsunoo et al. | |
| 3,651,283 | A | 3/1972 | Doschek | |
| 4,228,327 | A | 10/1980 | Sawafuji | |
| 4,284,167 | A | 8/1981 | Kozlow et al. | |
| 4,492,827 | A | 1/1985 | Shintaku | |
| 4,547,631 | A | 10/1985 | Nieuwendijk et al. | |
| 4,783,824 | A * | 11/1988 | Kobayashi | H04R 9/025 381/402 |
| 5,317,552 | A | 5/1994 | Yamasaki | |
| 5,402,503 | A | 3/1995 | Prokisch | |
| 5,687,248 | A | 11/1997 | Yen et al. | |
| 5,729,617 | A | 3/1998 | Gruber | |
| 6,542,617 | B1 * | 4/2003 | Fujihira | H04R 9/04 381/402 |
| 6,714,655 | B2 | 3/2004 | Iwasa et al. | |
| 6,724,909 | B2 * | 4/2004 | Tsumori | H04R 9/025 381/124 |
| 6,739,425 | B1 | 5/2004 | Griffin et al. | |
| 6,973,194 | B2 | 12/2005 | Iwasa et al. | |
| 7,006,654 | B2 | 2/2006 | Stiles et al. | |
| 7,477,757 | B2 | 1/2009 | Stiles | |
| 7,502,486 | B2 | 3/2009 | Shin et al. | |
| 8,335,339 | B2 | 12/2012 | Tagami et al. | |
| 8,891,809 | B2 | 11/2014 | Danovi | |
| 10,499,158 | B2 | 12/2019 | Bushko | |
| 2004/0120542 | A1 | 6/2004 | Morris, III | |
| 2004/0156527 | A1 * | 8/2004 | Stiles | H04R 9/063 381/412 |
| 2004/0218778 | A1 | 11/2004 | Weisman | |
| 2005/0031154 | A1 | 2/2005 | Stiles | |
| 2007/0147651 | A1 | 6/2007 | Mitobe et al. | |
| 2007/0297639 | A1 | 12/2007 | Noll | |
| 2010/0183171 | A1 | 7/2010 | Hsu Huang et al. | |
| 2011/0158462 | A1 | 6/2011 | Horigome et al. | |
| 2012/0051557 | A1 | 3/2012 | Horigome et al. | |
| 2012/0237077 | A1 * | 9/2012 | Nedelcu | H04R 9/063 381/397 |
| 2015/0146910 | A1 | 5/2015 | Beer et al. | |
| 2016/0345099 | A1 | 11/2016 | Bushko et al. | |
| 2016/0345100 | A1 | 11/2016 | Bushko | |

FOREIGN PATENT DOCUMENTS

| | | | |
|---|---|---|---|
| JP | H1155789 | A | 2/1999 |
| JP | 3893694 | B2 | 3/2007 |
| JP | 3902066 | B2 | 4/2007 |
| JP | 2007281869 | A | 10/2007 |
| JP | 4687400 | B2 | 5/2011 |

* cited by examiner

DUAL-FIELD SINGLE-VOICE-COIL TRANSDUCER

PRIORITY CLAIM

This filing is a continuation-in-part of prior-filed U.S. patent application Ser. No. 16/679,467 (filed on Nov. 11, 2019), which itself claims the benefit of U.S. patent application Ser. No. 14/716,126 (filed on May 19, 2015, now issued U.S. Pat. No. 10,499,158), each of which is incorporated by reference in its entirety.

TECHNICAL FIELD

This disclosure generally relates to loudspeakers. More particularly, the disclosure relates to electro-acoustic transducers with a dual-field core.

BACKGROUND

Conventional electro-acoustic transducers with vertical (or along-output axis) asymmetry are limited in terms of power, or field intensity. There is a need for a more stable, higher power transducer.

SUMMARY

All examples and features mentioned below can be combined in any technically possible way.

Various implementations include loudspeaker transducers. The loudspeakers can include a dual-field magnetic core with improved stability and performance when compared with conventional transducers.

In some particular aspects, an electro-acoustic transducer includes: a diaphragm configured to move along an axis; a voice coil having a plurality of windings around the axis; a voice coil support configured to transfer forces from the voice coil to the diaphragm; a support structure that inhibits radial motion or tilting motion of the diaphragm and the voice coil support; and a magnetic core for driving the voice coil, the magnetic core including: two magnets having opposite polarity and approximately equal magnetic strength, where each of the magnets surrounds the voice coil, where a magnetic field from each magnet is approximately symmetric along the axis, and where the magnetic field from both magnets drives the voice coil.

In other particular aspects, an electro-acoustic transducer includes: a first diaphragm configured to move along an axis; a voice coil having a plurality of windings around the axis; a voice coil support configured to transfer forces from the voice coil to the first diaphragm; a magnetic core for driving the voice coil, the magnetic core having: a plurality of magnets each surrounding the voice coil, at least two of which have opposite polarity and at least two of which have approximately equal magnetic strength, where a magnetic field from each magnet in the plurality of magnets is approximately symmetric along the axis, and where the magnetic field from the at least two magnets drives the voice coil; and a first support structure below the magnetic core, on an opposite side of the magnetic core than the first diaphragm.

In additional particular aspects, an electro-acoustic transducer includes: a diaphragm configured to move along an axis; a magnetic core for driving a voice coil, the magnetic core including: two magnets having opposite polarity and approximately equal magnetic strength, where each of the magnets surrounds the voice coil or the voice coil surrounds each of the magnets, where a magnetic field from each magnet is approximately symmetric along the axis, and where the magnetic field from both magnets drives the voice coil; a voice coil support configured to transfer forces from the voice coil to the diaphragm; and a support structure that inhibits radial motion or tilting motion of the diaphragm and the voice coil support.

In further particular aspects, an electro-acoustic transducer includes: a diaphragm configured to move along an axis; a voice coil having a plurality of windings around the axis; a voice coil support configured to transfer forces from the voice coil to the diaphragm; a support structure that inhibits radial motion or tilting motion of the diaphragm and the voice coil support; and a magnetic core for driving the voice coil, the magnetic core including: two magnets having opposite polarity and approximately equal magnetic strength, where each of the magnets surrounds the voice coil or the voice coil surrounds each of the magnets, where a magnetic field from each magnet is approximately symmetric along the axis, and where the magnetic field from both magnets drives the voice coil.

Implementations may include one of the following features, or any combination thereof.

In some cases, the magnetic core includes: a metal core section; an upper metal layer; a middle metal layer; and a lower metal layer, where a first one of the magnets is located between the upper metal layer and the middle metal layer, and where a second one of the magnets is located between the middle metal layer and the lower metal layer.

In particular cases, the two magnets each wrap around the metal core section.

In certain aspects, the upper metal layer includes at least two sub-layers over an upper one of the two magnets and the lower metal layer includes at least two sub-layers under a lower one of the two magnets.

In particular implementations, the metal core section is physically distinct from the upper metal layer and the lower metal layer.

In some cases, the support structure is located between the magnetic core and the diaphragm, and the lower metal layer is located directly under the second magnet and seals an acoustic volume behind the support structure.

In certain aspects, the metal core section includes distinct sub-sections, and an upper sub-section is unitary with the upper metal layer and a lower sub-section is unitary with the lower metal layer.

In particular cases, the upper sub-section and the lower sub-section include steel.

In some implementations, the transducer further includes: an additional diaphragm configured to move along the axis; an additional voice coil having a plurality of windings around the axis; and an additional voice coil support configured to transfer forces from the additional voice coil to the additional diaphragm, where the magnetic core further includes a third magnet having an opposite polarity from an adjacent one of the two magnets, where a magnetic field from the third magnet and the adjacent magnet drives the additional voice coil independently of the voice coil.

In certain cases, the two magnets are vertically stacked, an upper magnet has one of a north-south polarity or a south-north polarity, and a lower magnet has the other of the north-south polarity or the south-north polarity.

In particular implementations, the magnetic core includes at least one vertically oriented opening for accommodating the voice coil support.

In some aspects, the at least one vertically oriented opening includes at least three vertically oriented openings extending through the magnetic core.

In certain cases, the support structure is located below the magnetic core on an opposite side of the magnetic core from the diaphragm.

In particular implementations, the transducer further includes an additional support structure located above the magnetic core, between the magnetic core and the diaphragm.

In some aspects, the electro-acoustic transducer includes a woofer.

In certain implementations, the magnetic core includes a metal core section, and each of the plurality of magnets wraps entirely around the metal core section.

In particular cases, the support structure is located between the magnetic core and the diaphragm, and a lower metal layer in the magnetic core is located directly under a lowermost one of the two magnets in the magnetic core and seals an acoustic volume behind the support structure.

In some implementations, the magnetic core includes at least three vertically oriented openings for accommodating the voice coil support, where the support structure is located below the magnetic core on an opposite side of the magnetic core from the diaphragm, and the electro-acoustic transducer further includes an additional support structure located above the magnetic core, between the magnetic core and the diaphragm.

In certain cases, the core includes a bobbin having: a central spindle aligned with the axis; and a set of fingers extending from the central spindle and supporting the voice coil.

Two or more features described in this disclosure, including those described in this summary section, may be combined to form implementations not specifically described herein.

The details of one or more implementations are set forth in the accompanying drawings and the description below. Other features, objects and benefits will be apparent from the description and drawings, and from the claims.

Figure 1:
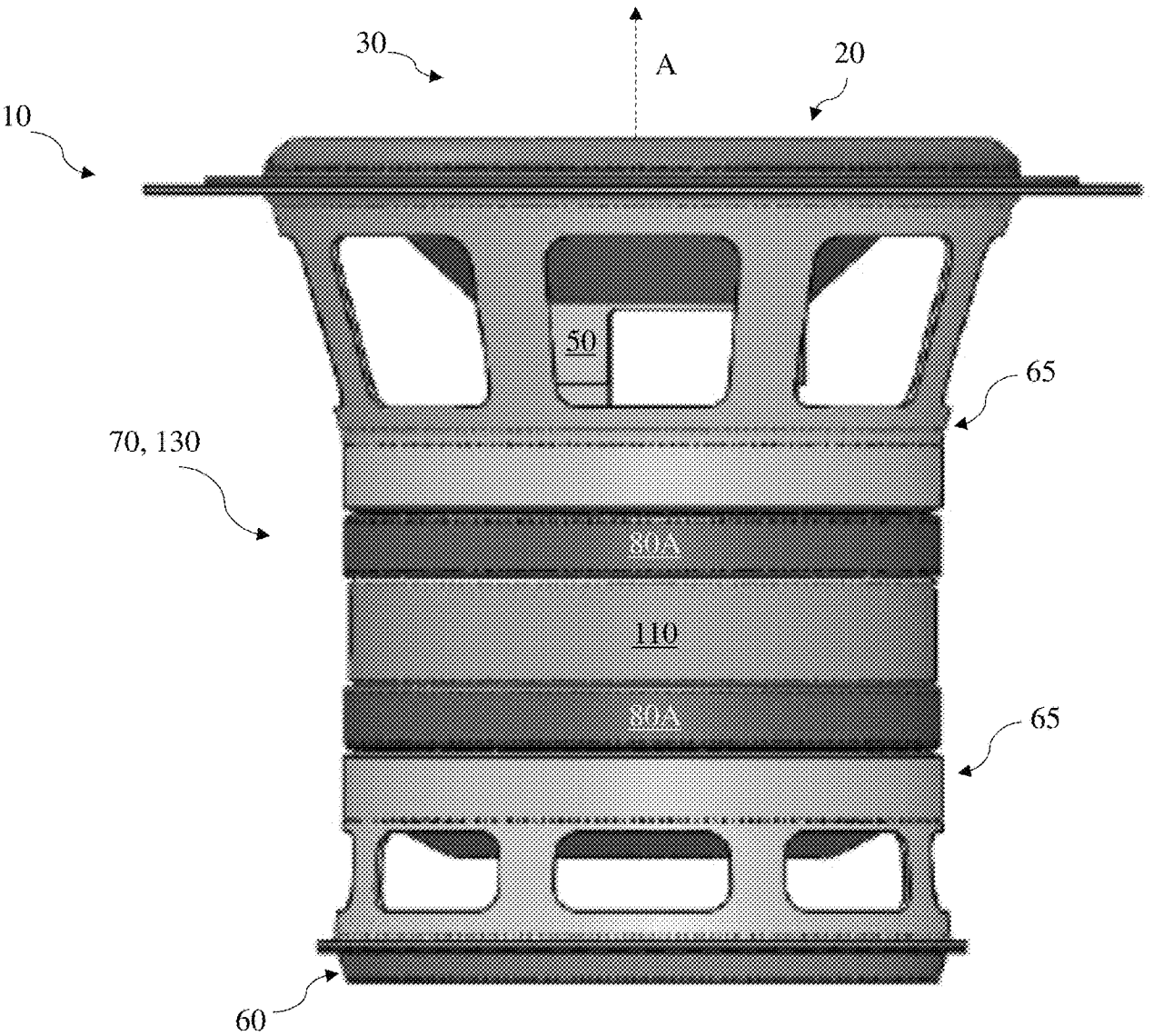
FIG. 1 is a side view of an electro-acoustic transducer according to various implementations.

It is noted that the drawings of the various implementations are not necessarily to scale. The drawings are intended to depict only typical aspects of the disclosure, and therefore should not be considered as limiting the scope of the implementations. In the drawings, like numbering represents like elements between the drawings.

DETAILED DESCRIPTION

This disclosure is based, at least in part, on the realization that a loudspeaker transducer with an approximately symmetric magnetic core can provide increased stability and power relative to conventional transducers. For example, a loudspeaker transducer can include a dual-field core with magnets that each surround a voice coil. In other examples, the loudspeaker transducer includes dual-field core with the voice coil surrounding each of the magnets. In any case, power output (e.g., as measured by the magnetic field from the core) can be upwards of approximately 50-80% greater in the loudspeaker transducers disclosed according to various implementations as compared with conventional asymmetric transducers.

Commonly labeled components in the FIGURES are considered to be substantially equivalent components for the purposes of illustration, and redundant discussion of those components is omitted for clarity. Numerical ranges and values described according to various implementations are merely examples of such ranges and values, and are not intended to be limiting of those implementations. In some cases, the term "approximately" is used to modify values, and in these cases, can refer to that value+/−a margin of error, such as a measurement error, which may range from up to 1-5 percent.

Figure 2:
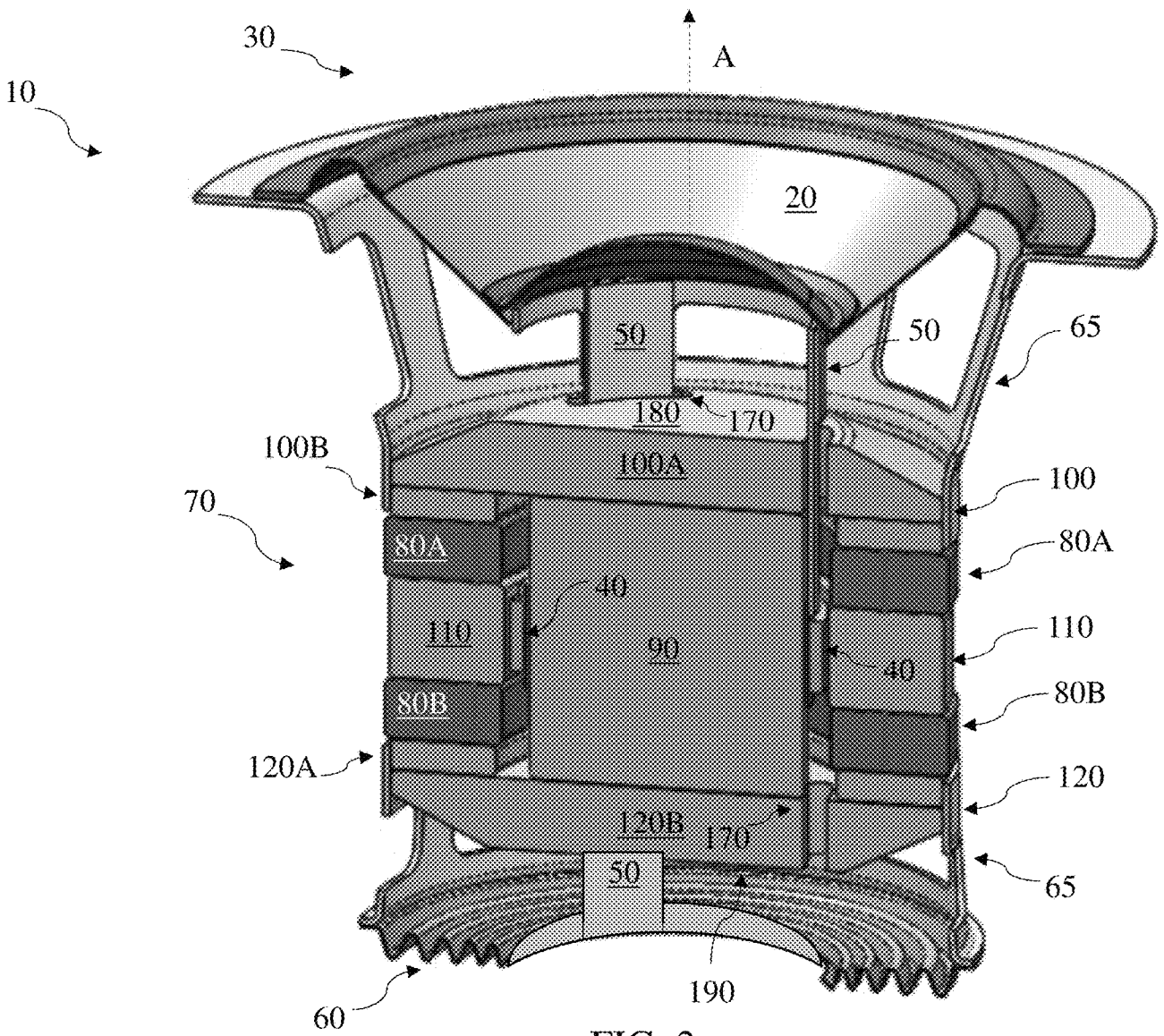
FIG. 2 shows a cut-away perspective view of the transducer of FIG. 1 according to various implementations.

FIG. 1 is a side view of an electro-acoustic transducer (or simply, "transducer") 10 according to various implementations. FIG. 2 shows the transducer 10 in a perspective cut-away view. In certain implementations, the transducer 10 includes a low frequency (LF) driver or a low-to-mid frequency driver. In some particular examples depicted herein, the transducer 10 is a LF driver (or, woofer). While components in the transducer 10 and additional transducers of the various disclosed implementations are described in detail, certain components are only briefly described herein. An example additional transducer configuration is illustrated in U.S. patent application Ser. No. 14/716,126 (Electro-Acoustic Transducer with Radiating Acoustic Seal and Stacked Magnetic Circuit Assembly, filed on May 19, 2015), which is incorporated by reference herein in its entirety.

Turning to FIGS. 1 and 2, the transducer 10 is shown having a diaphragm (or, "cone") 20 configured to move along an axis (A) (also referred to as the primary axis of the transducer 10), in order to provide an audio output to the front 30 of the transducer 10 (e.g., into the ambient environment). A voice coil 40 (FIG. 2) is shown around the axis (A), and in various implementations, includes a plurality of windings that are obstructed in this view. In various implementations, the transducer 10 further includes a voice coil support 50 that is configured to transfer forces from the voice coil 40 to the diaphragm 20, e.g., to drive the audio output from the transducer 10. Certain implementations include a support structure 60 (also referred to as a "spider") that provides stability and limits motion to axial movement, and thereby inhibits radial motion and/or tilting motion of the diaphragm 20 and/or voice coil support 50. As illustrated herein, various components are contained within or otherwise coupled with one or more sections of a frame 65.

In various implementations, the transducer 10 further includes a magnetic core 70 for driving the voice coil 40. In certain cases, the magnetic core 70 includes at least two magnets 80 (designated as distinct magnets 80A, 80B). In additional implementations, the magnetic core 70 includes three, four, five or more magnets. In the example implementation depicted in FIGS. 1 and 2, the two magnets 80A, 80B have opposite polarity and approximately equal magnetic strength. In certain cases, as depicted in FIGS. 1 and 2, the two magnets 80A, 80B are vertically stacked, and an upper magnet (e.g., 80A) has one of a north-south polarity or a south-north polarity, and a lower magnet (e.g., 80B) has the other of the north-south polarity or the south-north polarity. Example polarities (S-N and N-S, respectively) are illustrated by arrows in FIG. 2. In certain cases, each of the magnets 80A, 80B surrounds the voice coil 40. In various implementations, the magnets 80A, 80B each wrap around the voice coil 40, and can take any of a number of cross-sectional shapes, e.g., circular, square, rectangular, etc. In the example shown in FIGS. 1 and 2, the magnets 80A, 80B are circular or approximately circular. In particular examples, each magnet 80A, 80B is formed as a single (unitary) component that completely surrounds the voice coil 40 in a first dimension (e.g., radial dimension perpendicular to the axis (A)).

In operation, the magnetic field from both magnets 80A, 80B drives the voice coil 40. Further, in contrast to conventional transducers, the magnetic field from each magnet 80A, 80B is approximately equal, unlike conventional transducers that include a primary magnet and a weaker bucking magnet. The approximately equal field strength of the magnets 80A, 80B combine to provide an increased magnetic field in which the voice coil 40 sits. Such an arrangement of approximately equal magnets may increase the magnetic field strength by 50-80% over conventional designs. Additionally, the approximately equal magnetic field strength of the magnets 80A, 80B causes the magnetic field around the voice coil to be approximately symmetric along the axis (A). A change in field strength due to a displacement of the voice coil 40 in one direction along the axis (A) is approximately equal to a change in field strength due to an equal displacement in the other direction along the axis (A). Accordingly, a symmetric magnetic field, as in accord with implementations herein, yields a transducer having greater linearity.

In particular aspects, as shown in the example configuration in FIG. 2, the magnetic core 70 can include a plurality of sub-components. For example, in FIG. 2, the magnetic core 70 is shown including a metal core section 90, an upper metal layer 100, a middle metal layer 110, and a lower metal layer 120. In various example implementations, the metal core and metal layers include steel or other suitable transducer metal(s). In the example depicted in FIG. 2, the metal core section 90 is physically distinct from the upper metal layer 100 and the lower metal layer 120, i.e., they are non-unitary components.

In particular cases, as shown in FIG. 2, the upper metal layer 100 and the lower metal layer 120 each include at least two sub-layers 100A, 100B and 120A, 120B. A first one of the magnets 80A is located between the upper metal layer 100 and the middle metal layer 110 (e.g., between sub-layer 100B and middle metal layer 110). A second one of the magnets 80B is located between the middle metal layer 110 and the lower metal layer 120 (e.g., between middle metal layer 110 and sub-layer 120A). In these cases, the upper metal layer 100 includes at least two sub-layers 100A, 100B that are over an upper one of the magnets 80A, and the lower metal layer 120 includes at least two sub-layers 120A, 120B that are under a lower one of the magnets 80B. In any case, each of the magnets 80A, 80B wraps around the metal core section 90. That is, in various implementations, the magnets 80A, 80B wrap entirely around the metal core section 90. Additionally, as illustrated herein, the voice coil 40 wraps around the metal core section 90 in various implementations.

Figure 3:
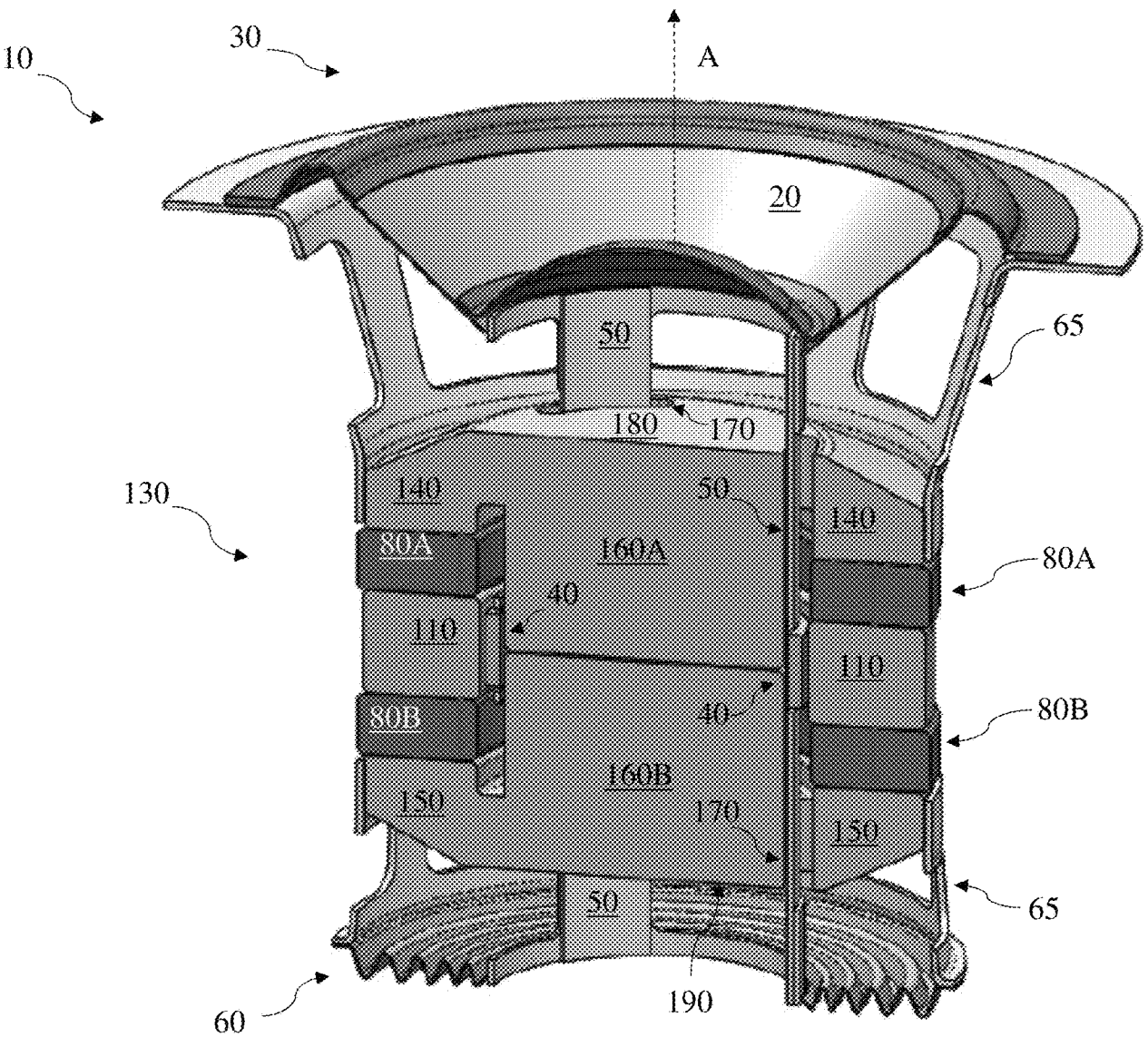
FIG. 3 shows a cut-away perspective view of the transducer of FIG. 1 according to various additional implementations.

FIG. 3 illustrates another implementation of the transducer 10 with a distinct magnetic core 130 that has an upper metal layer 140 and lower metal layer 150 without the sub-layers illustrated in FIG. 2. In this case, a metal core section 160 includes distinct sub-sections 160A, 160B, such that each sub-section 160A, 160B of the metal core section 160 is unitary with one of the upper metal layer 140 and the lower metal layer 150, respectively. That is, the upper metal layer 140 is combined with the subsection 160A of the metal core section 160, and the lower metal layer 150 is combined with the subsection 160B of the metal core section, each forming an approximately "mushroom-shaped" core element. These implementations can include the same middle metal layer 110 as described with respect to the magnetic core 70 in FIG. 2. As described with respect to the magnetic core 70, the magnets 80A, 80B surround the voice coil in magnetic core 130.

An additional (lower) voice coil support 50 is illustrated in FIG. 2 and FIG. 3. Voice coil supports 50 are shown accommodated by vertically oriented openings 170 in the magnetic cores (e.g., magnetic cores 70, 130 in FIG. 2 and FIG. 3, respectively). In certain implementations, as described herein, each magnetic core can include a plurality of vertically oriented openings 170 for accommodating voice coil supports 50. In particular examples, the magnetic cores described herein can include at least three vertically oriented openings 170 extending therethrough for accommodating voice coil supports 50. In the example implementations depicted in FIGS. 1-3, the magnetic cores 70, 130 are "double-sided", in that those cores include vertically oriented openings 170 on both the upper surface 180 and lower surface 190 of the cores 70, 130. That is, the uppermost metal layer and lowermost metal layer of the cores 70, 130 includes vertically oriented openings 170 for accommodating (holding) the voice coil supports 50. This can allow for structural connection between the voice coil 40 and an overlying diaphragm 20, as well as an underlying (or overlying) support structure 60.

In certain cases, magnetic core 70 (FIG. 2) and magnetic core 130 (FIG. 3) can be used interchangeably. However, each type of magnetic core can present relative benefits. For example, the relative simplicity of the components in magnetic core 70 can provide a cost savings compared with the more complex "mushroom-shaped" components in magnetic core 130. However, the unitary nature of the components in magnetic core 130 can provide an enhanced magnetic circuit relative to the multi-part magnetic core 70 (e.g., due to fewer interruptions in the metal layers).

Figure 4:
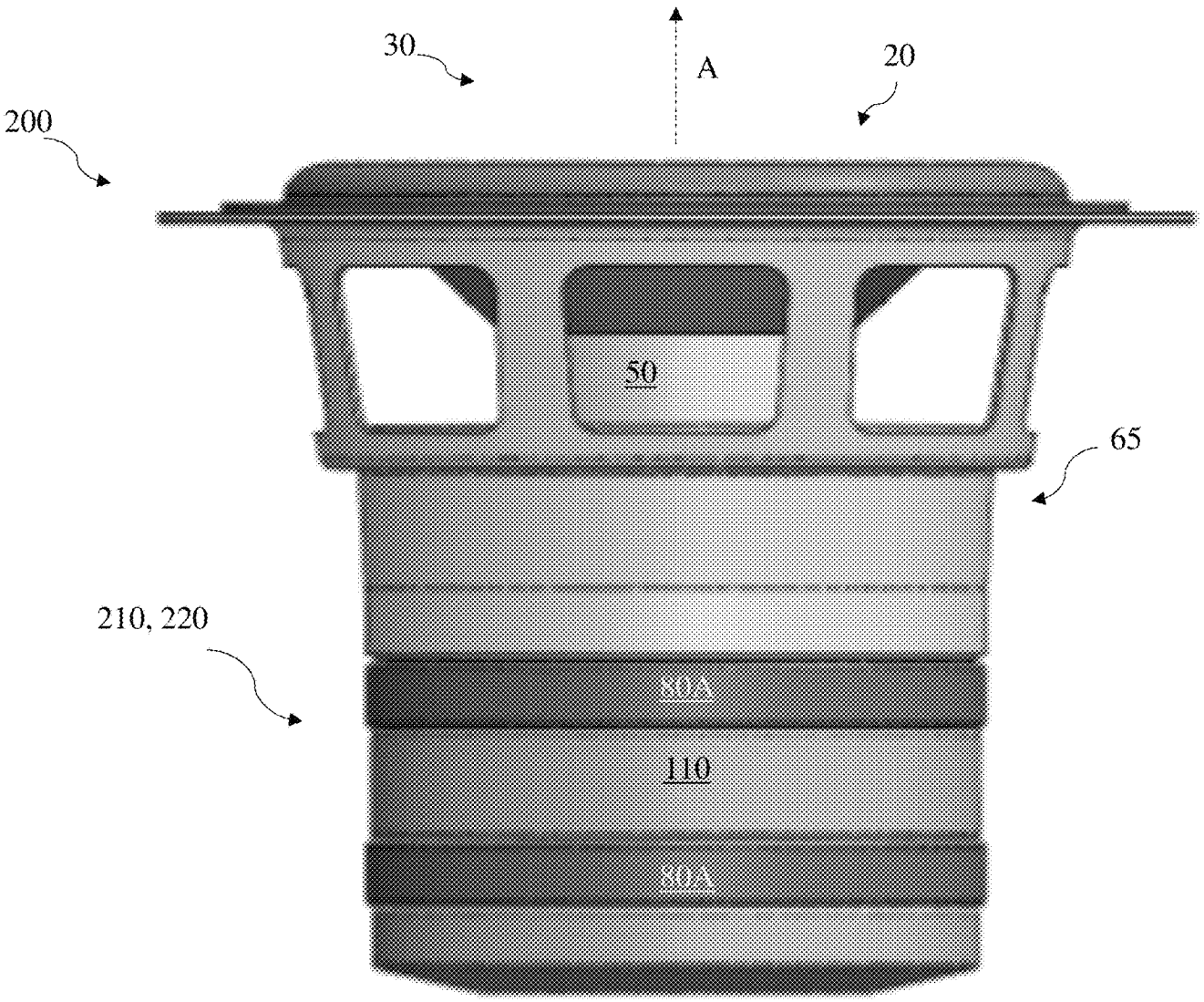
FIG. 4 is a side view of an additional variation on a transducer according to implementations.
Figure 5:
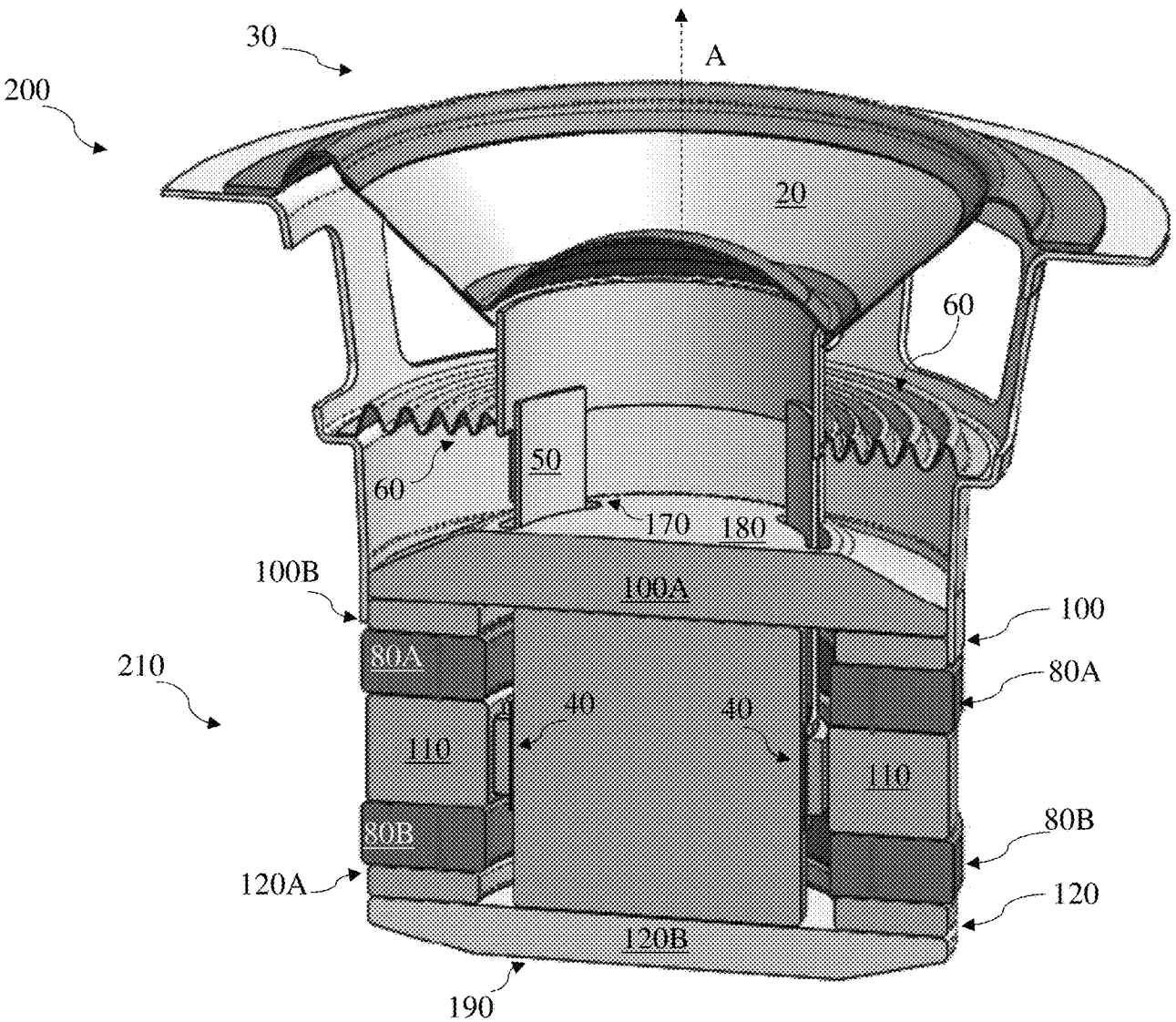
FIG. 5 shows a cut-away perspective view of the transducer of FIG. 4 according to various implementations.
Figure 6:
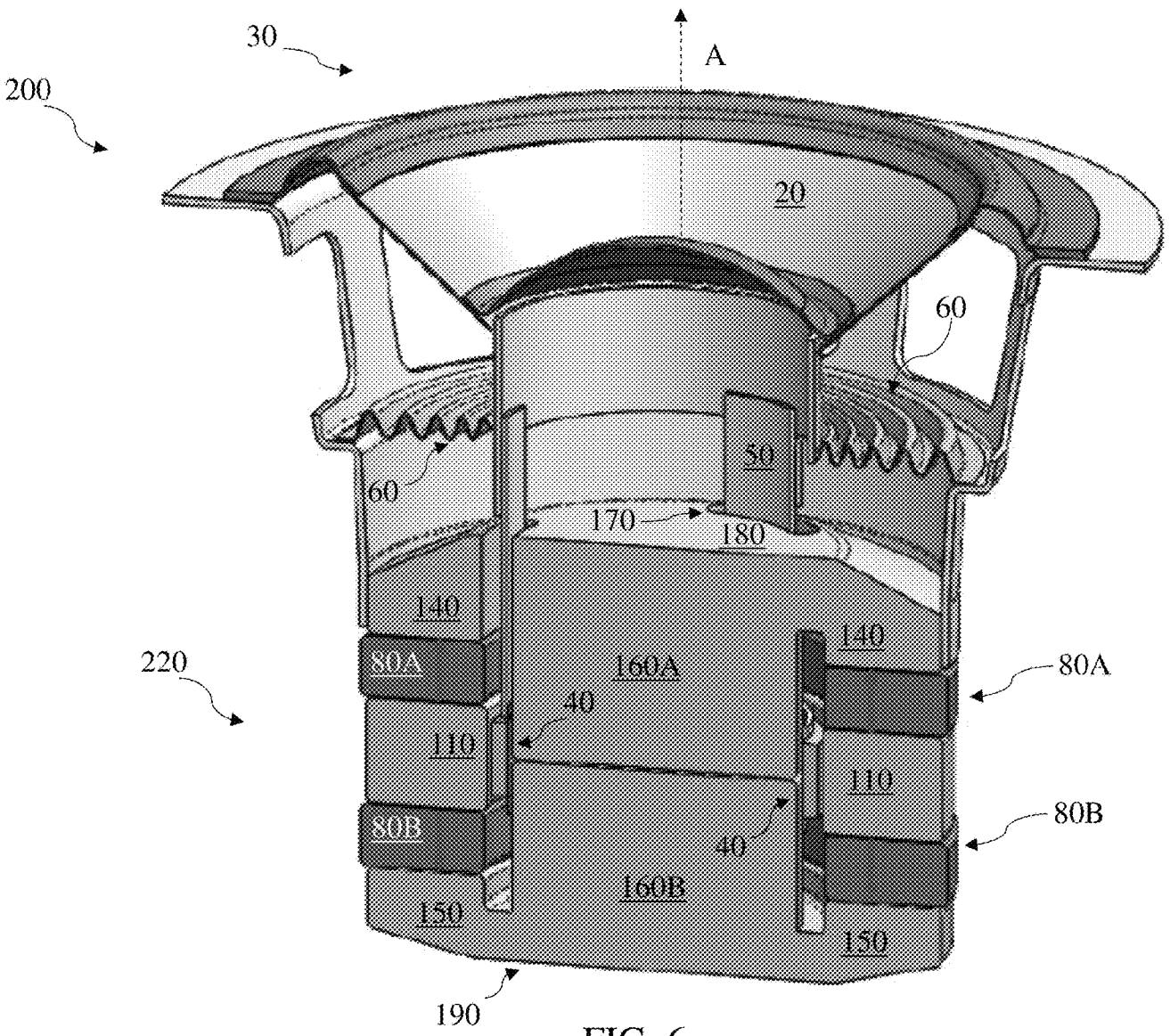
FIG. 6 shows a cut-away perspective view of the transducer of FIG. 4 according to various additional implementations.

FIGS. 1-3 each illustrate a transducer 10 that has a support structure 60 located below a magnetic core (e.g., magnetic core 70 or 130) on an opposite side of the magnetic core from the diaphragm 20. In contrast, FIGS. 4-6 illustrate an additional transducer 200 that has a support structure 60 located between a magnetic core 210, 220 and the diaphragm 20. In these implementations, the magnetic cores 210 (FIG. 5) and 220 (FIG. 6) are considered "single-sided", in that connection between the voice coil 40 and a diaphragm 20 or support structure (spider) 60 is implemented on only one side of the core 210, 220 (e.g., via voice coil supports 50 extending through vertically oriented openings 170 on the upper surface 180). In these implementations, magnetic cores 210, 220 can include many similar components as described with respect to the magnetic cores 70, 130 in FIGS. 1-3. However, magnetic cores 210, 220 do not include vertically oriented openings 170 on the lower surface 190 in the lower metal layer 120 (FIG. 5) or the lower metal layer 150 (FIG. 6). In these cases, the lower metal layer 120 in FIG. 5 and the lower metal layer 150 in FIG. 6 seal an acoustic volume behind the support structure 60. In some examples, such as in the magnetic core 220 in FIG. 6, the lower metal layer 150 is located directly under the second magnet 80B.

Figure 7B:
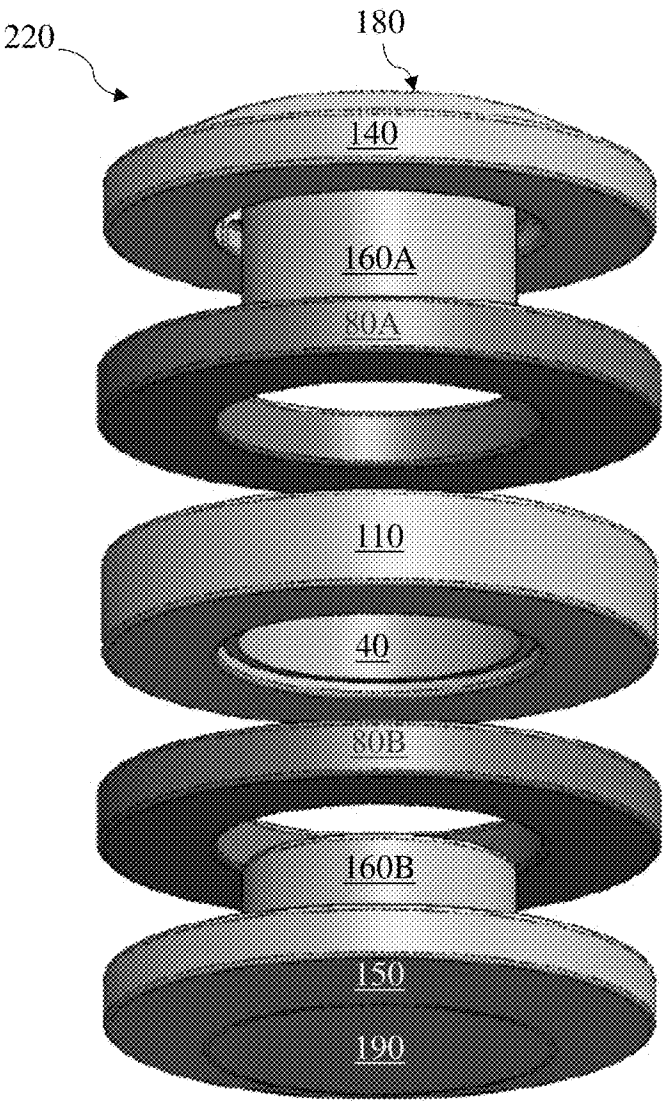
FIGS. 7A and 7B show break-away views of magnetic cores according to various implementations.
Figure 7A:
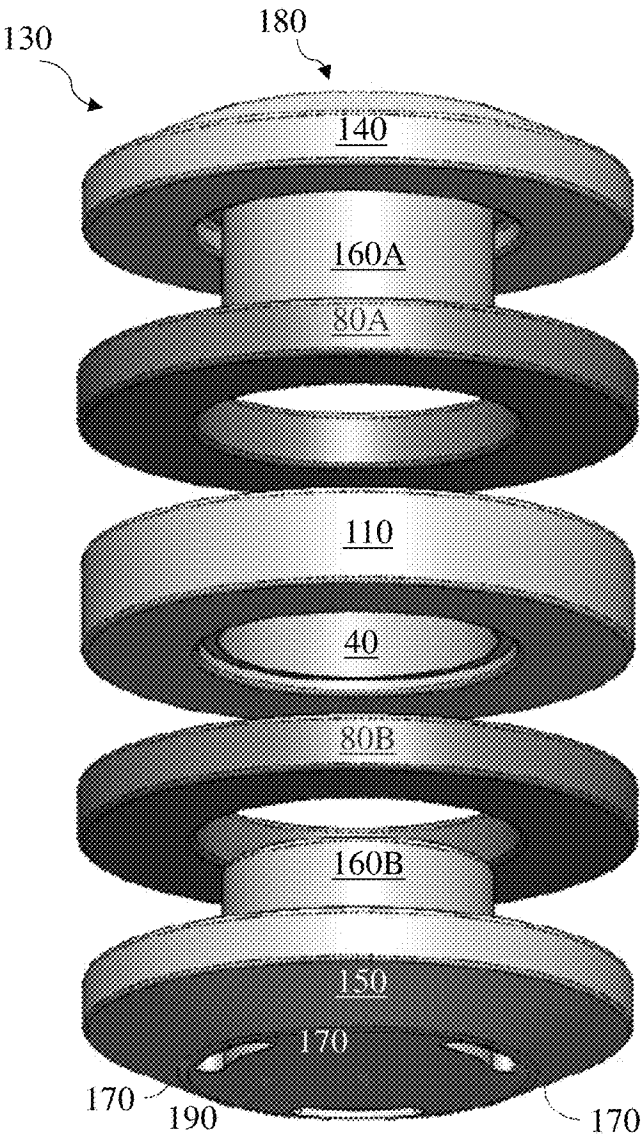

FIGS. 7A and 7B are side-by-side break-out illustrations of the ("mushroom" type) magnetic cores 130 and 220 from FIGS. 3 and 6, respectively. As shown, the magnetic core 130 includes vertically oriented openings 170 on the lower surface 190 while magnetic core 220 is sealed at the lower surface 190.

Figure 8B:
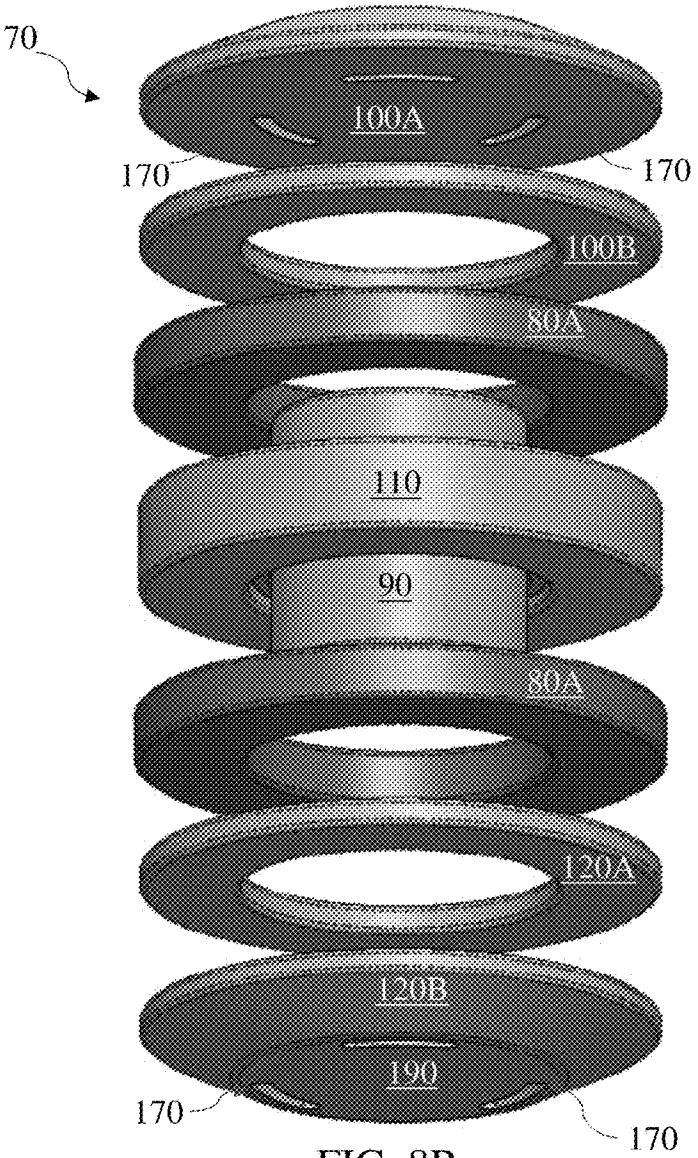
FIG. 8B shows a break-away view of the magnetic core of FIG. 8A.
Figure 8A:
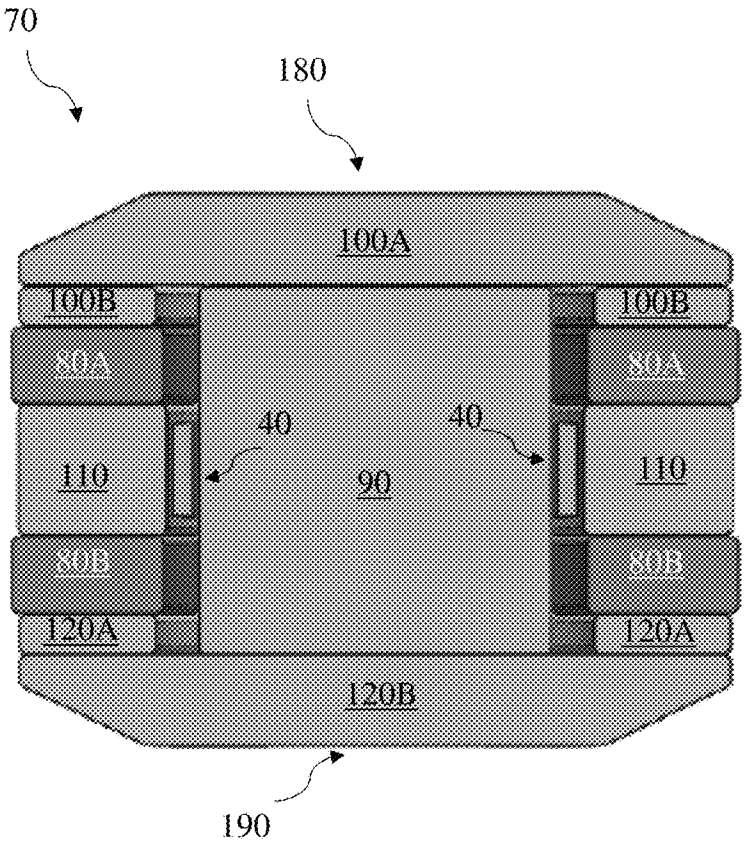
FIG. 8A shows a cross-sectional view of a magnetic core according to various implementations.
Figure 9B:
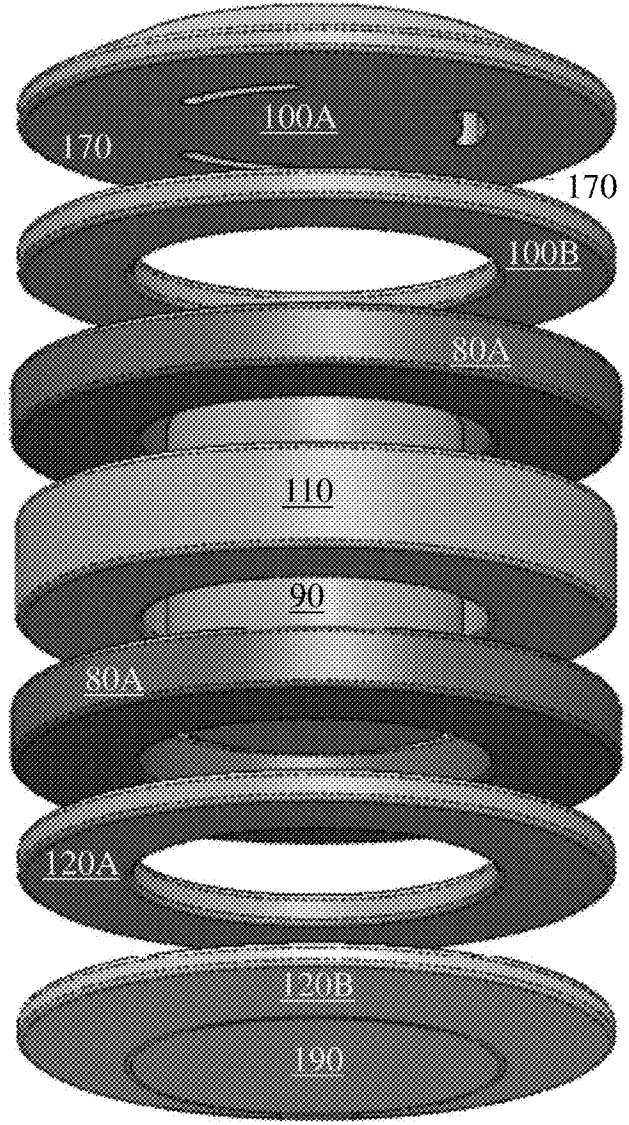
FIG. 9B shows a break-away view of the magnetic core of FIG. 8A.
Figure 9A:
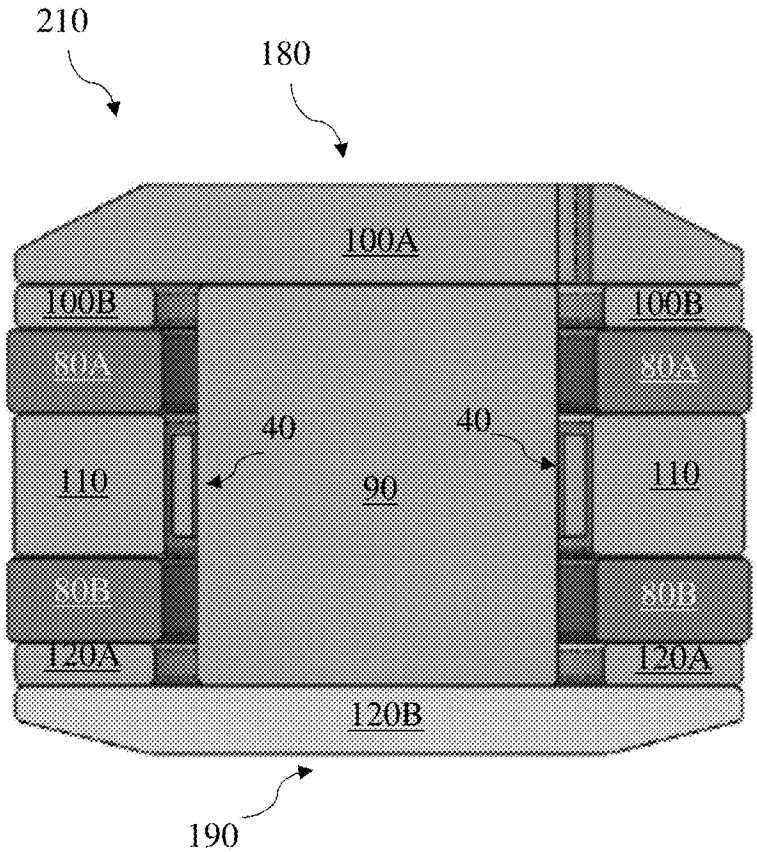
FIG. 9A shows a cross-sectional view of a magnetic core according to various implementations.

FIGS. 8A and 8B include cross-sectional and break-away views, respectively, of the magnetic core 70 that includes vertically oriented openings 170 on the upper surface 180 and lower surface 190. As shown in this implementation, the metal core section 90 stands alone as a separate physical component in break-away view. FIGS. 9A and 9B are cross-sectional and break-away views of the magnetic core 210 in FIG. 5, with similarities to magnetic core 70 in FIGS. 8A and 8B and distinctions in that the lowermost metal layer (e.g., sub-layer 120*b*) seals the acoustic volume behind the support structure 60 (FIG. 5) and does not include vertically oriented openings 170 on the lower surface 190 of the core 210.

Figure 10A:
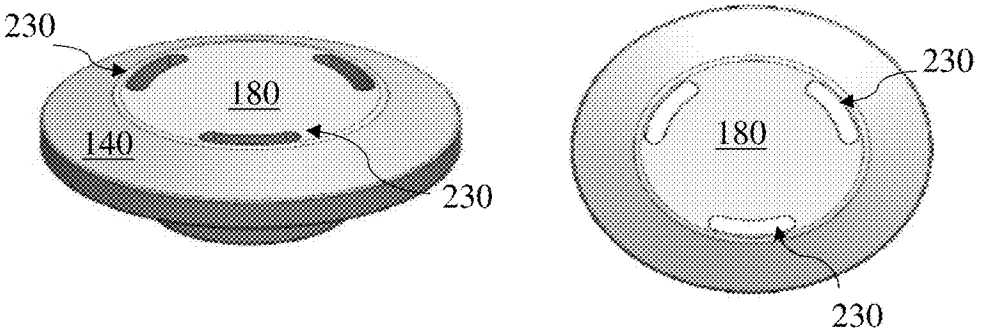
FIGS. 10A-10C each show perspective and top views, respectively, of metal layers in a magnetic core according to various implementations.
Figure 10B:
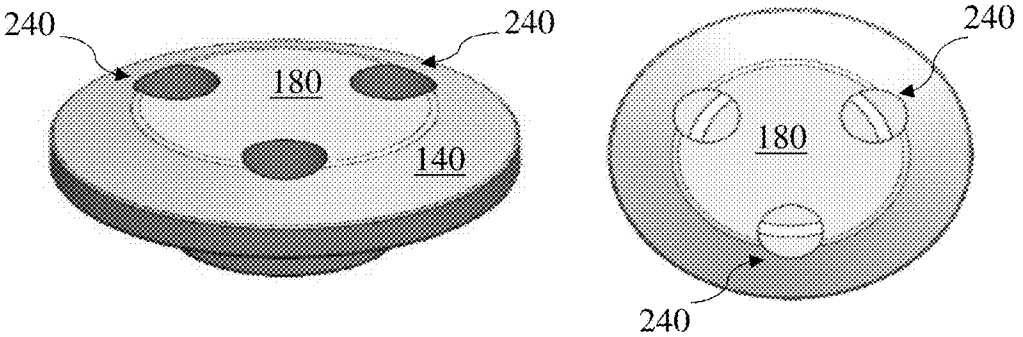
Figure 10C:
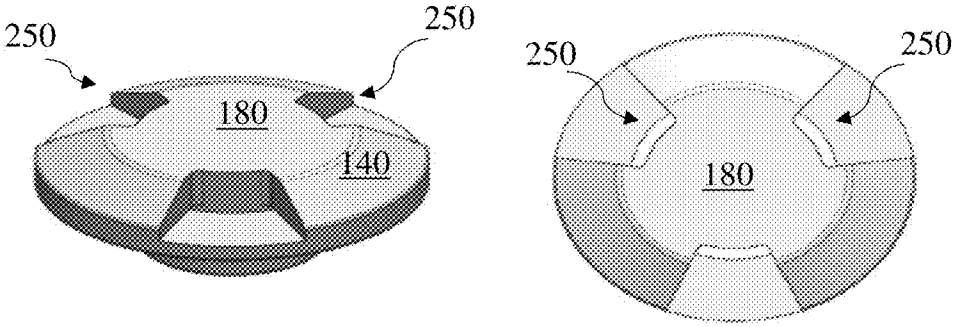
Figure 11A:
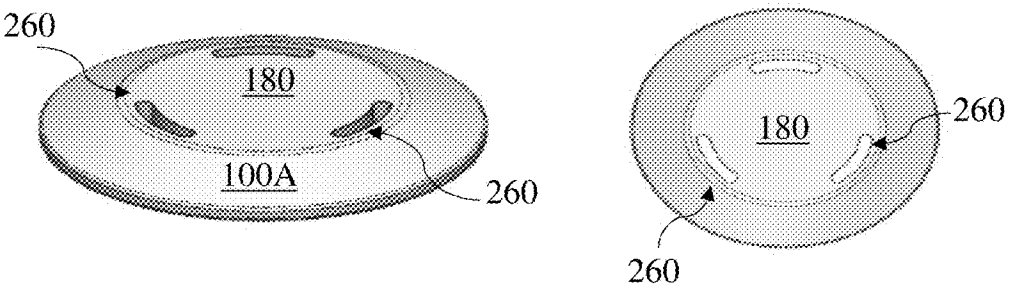
FIGS. 11A-11C each show perspective and top views, respectively, of metal layers in a magnetic core according to various implementations.
Figure 11B:
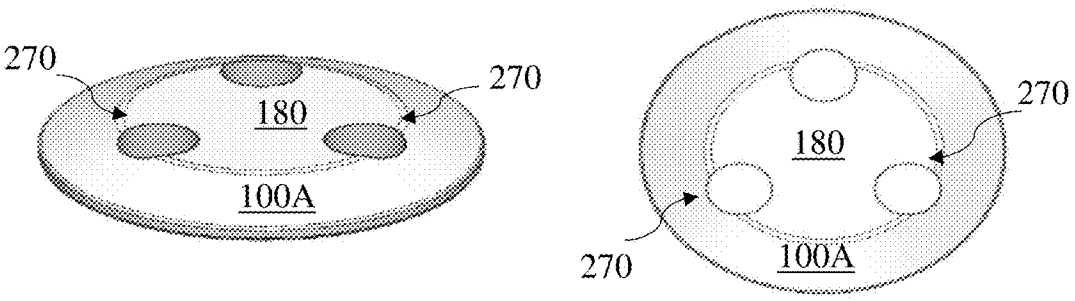
Figure 11C:
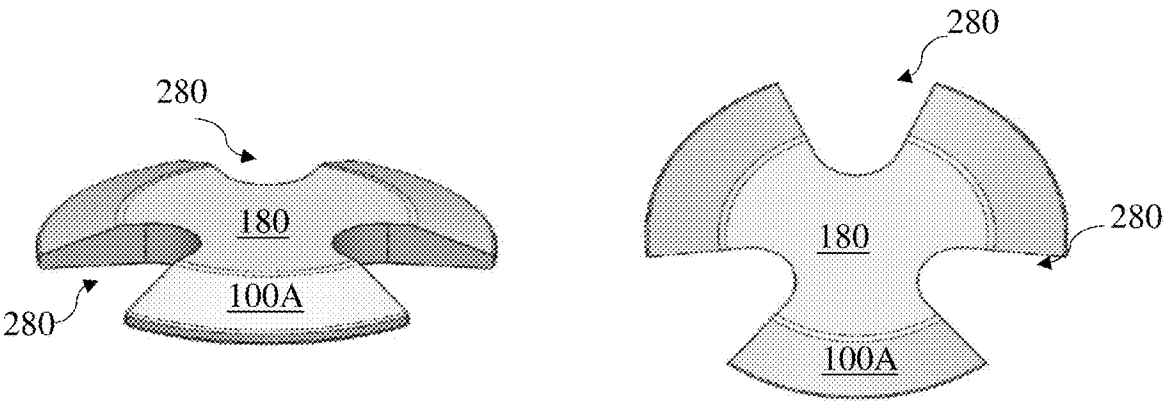

FIGS. 10A-C each illustrate perspective and top views of metal layers in the "mushroom" type cores (e.g., magnetic cores 130, 220) with vertically oriented openings 170. FIG. 10A illustrates elongated slots 230 that span at least approximately 10-15 degrees circumferentially about the metal layers. FIG. 10B illustrates rounded (e.g., circular or oblong) apertures 240 through the metal layer(s). FIG. 10C illustrates a stepped opening (e.g., slot) 250 in the metal layer(s), which can require less material than the metal layers depicted in FIGS. 10A and 10B. FIGS. 11A-C each illustrate perspective and top views of metal layers in the multi-layer cores (e.g., magnetic cores 70, 210) with vertically oriented openings 170. FIG. 11A illustrates elongated slots 260 similar to those depicted in FIG. 10A. FIG. 11B illustrated rounded apertures 270 similar to those depicted in FIG. 10B. FIG. 11C illustrates a flared opening 280 with an interrupted circumferential edge, which can require less material than the metal layers depicted in FIGS. 11A and 11B. It is understood that the metal layers shown in FIGS. 10A-10C and 11A-11C can include distinct numbers of openings (e.g., greater or fewer openings), one or more of which can take various alternate shapes.

Figure 12:
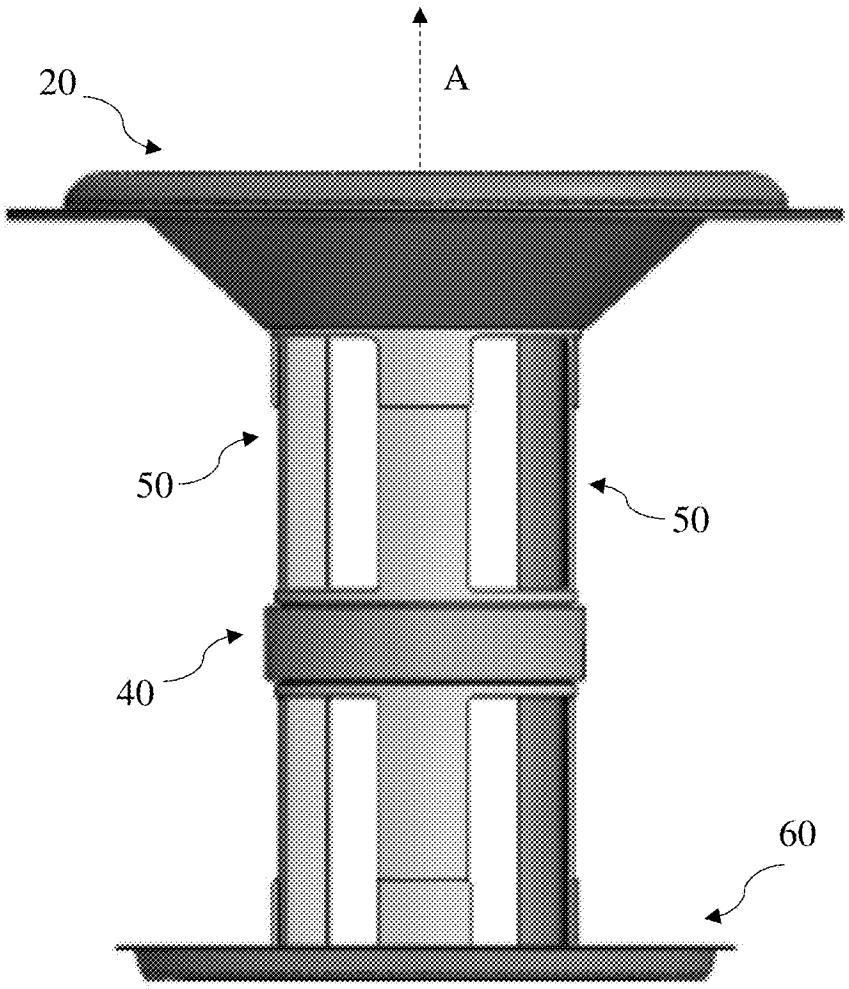
FIG. 12 shows a side view of a diaphragm, voice coil and voice coil support assembly according to various implementations.
Figure 13:
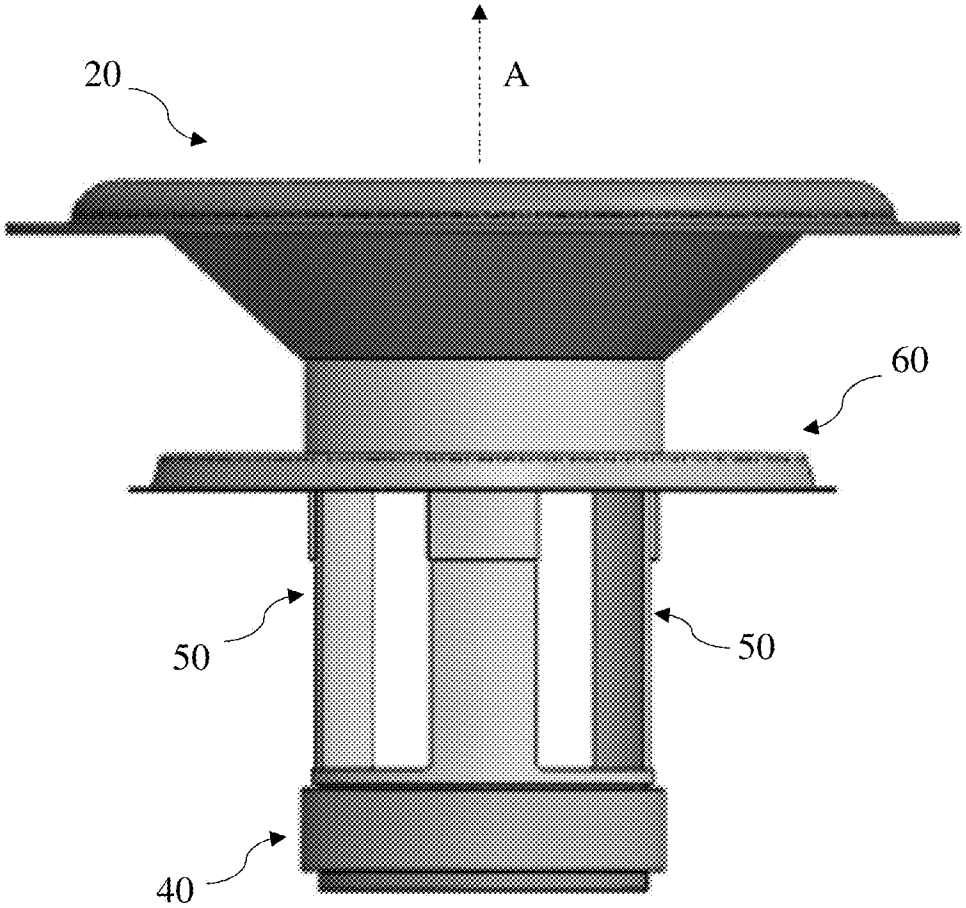
FIG. 13 shows a side view of a diaphragm, voice coil and voice coil support assembly according to various additional implementations.

FIG. 12 shows a side view of the diaphragm 20, voice coil 40, voice coil supports 50, and support structure 60 isolated from the transducer 10 in FIGS. 2 and 3. As shown, the voice coil supports 50 can both be driven by the voice coil 40 to affect output at the diaphragm 20 and support structure 60 on opposite sides of the magnetic core 70, 130 (FIGS. 2 and 3). FIG. 13 depicts the diaphragm 20, voice coil 40, voice coil support 50, and support structure 60 from FIGS. 4-6. As shown, the voice coil support 50 can be driven by the voice coil 40 to affect output at the diaphragm and support structure 60 on the same side of the magnetic core 210, 220 (FIGS. 5 and 6).

Figure 14:
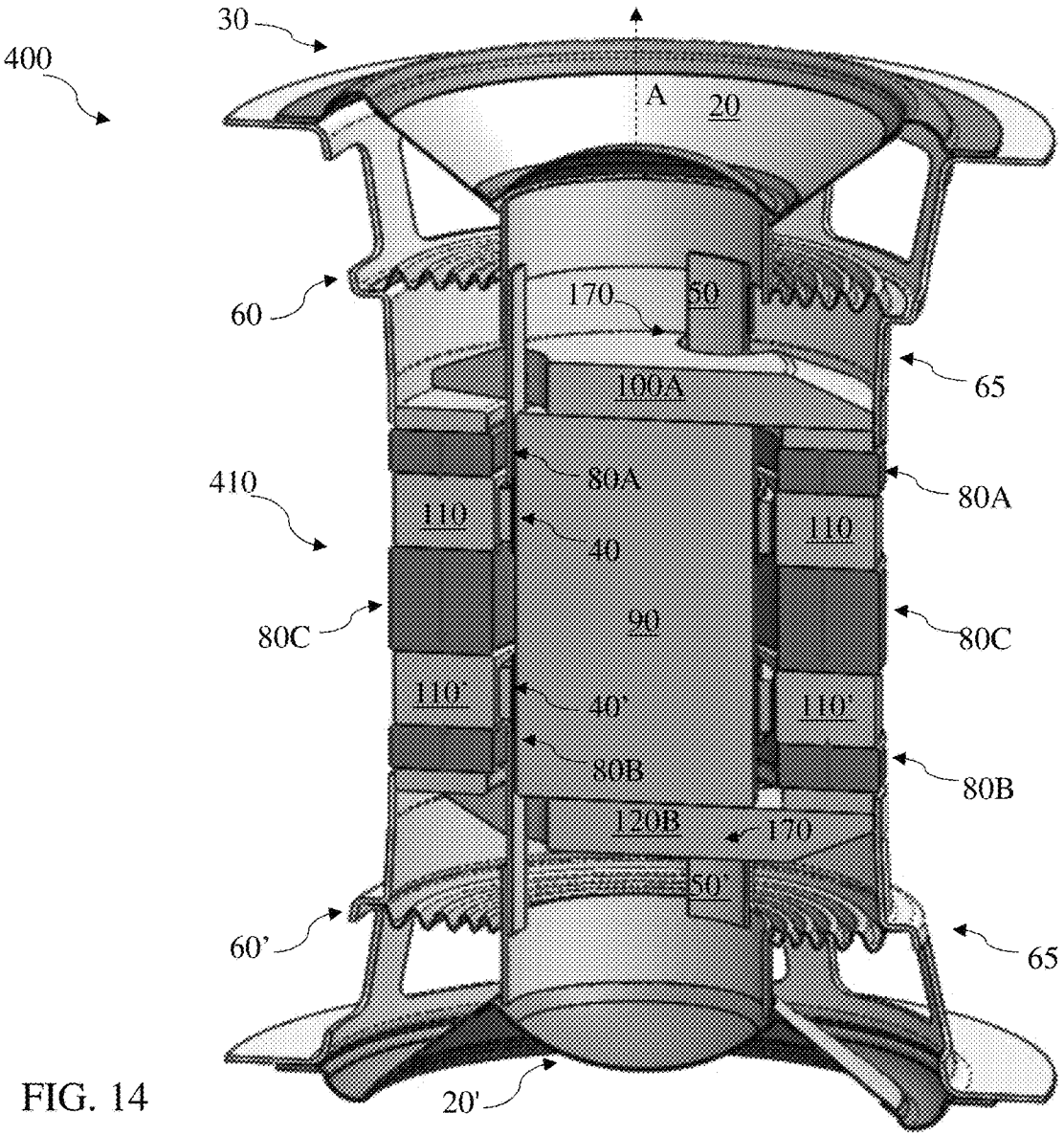
FIG. 14 is a cut-away perspective view of an electro-acoustic transducer according to various additional implementations.

FIG. 14 depicts an additional implementation of a transducer 400 that includes a magnetic core 410 with at least three magnets 80A, 80B, 80C, and additional middle metal layer 110'. The transducer 400 includes two diaphragms 20, 20' that are configured to move along the axis (A) to produce an audio output. The transducer 400 further includes two support structures 60, 60', located above and below the magnetic core 410, respectively, and also located between the magnetic core 410 and each of the diaphragms 20, 20'. As compared with the transducer 10 in FIG. 2, transducer 400 includes an additional voice coil 40' that has a plurality of windings around the axis (A), and an additional (physically separate) voice coil support 50' for the additional voice coil 40'. In this case, the third magnet 80C can have an opposite polarity from an adjacent one of the magnets 80A, 80B, and the magnetic field from the third magnet 80C and each adjacent magnet 80A or 80B drives the respective voice coils 40, 40' independently of one another.

Figure 15:
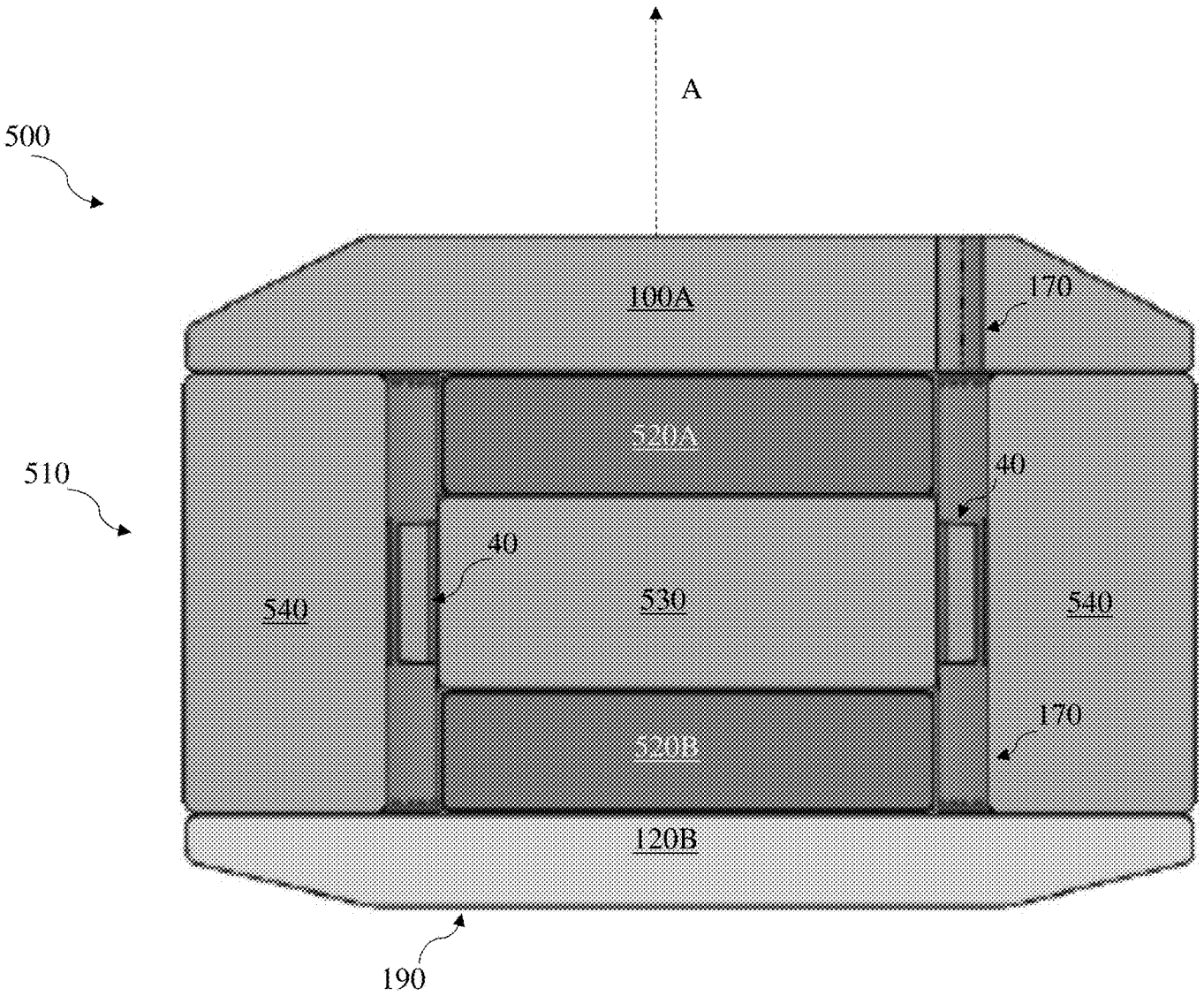
FIG. 15 is a cross-sectional view of an electro-acoustic transducer core according to various additional implementations.

While the voice coil(s) 40, 40' are described separately from the magnetic core(s) (e.g., magnetic core 70, 130, 210, 220, 410) in various implementations, it is understood that in additional implementations, the voice coil(s) 40, 40' may be positioned radially outboard of the magnets (e.g., magnets 80A, 80B, 80C) relative to axis (A). FIG. 15 illustrates a portion of an additional transducer 500 according to various additional example implementations. In these cases, transducer 500 includes a magnetic core 510 shown including a voice coil 40 located outboard of each of a pair of magnets 520A, 520B. The magnetic core 510 can include a plurality of metal layers, for example upper metal layer 100A and lower metal layer 120B similar to those described with reference to magnetic core 210 in FIGS. 9A and 9B. In this depicted example, the lower metal layer 120B seals the acoustic volume behind the support structure 60 (FIG. 5) and does not include vertically oriented openings 170 on the lower surface 190 of the core 510. However, in additional implementations, the lower metal layer 120B can include vertically oriented openings 170 such as those illustrated in the lower metal layers in FIGS. 1-3, for example, to allow for a support structure 60 on the lower side of the transducer 500. As shown in the example depiction in FIG. 15, the magnetic core 510 can further include a metal core section 530 and an outer metal section 540 that surrounds the metal core section 530. In various implementations, as illustrated in the example of FIG. 15, the outer metal section 540 surrounds both the voice coil 40 and the magnets 520A, 520B. Similar benefits can be achieved in electro-acoustic transducers having the voice coil(s) radially outboard of the magnets as in the other implementations described herein.

As noted herein, the transducers disclosed according to various implementations can improve stability and/or power output when compared with conventional devices. That is, these transducers have the technical effect providing a stabilized acoustic output across a frequency range, as well as improved power output.

One or more components in the transducer(s) can be formed of any conventional loudspeaker material, e.g., a heavy plastic, metal (e.g., aluminum, or alloys such as alloys of aluminum), composite material, etc. It is understood that the relative proportions, sizes and shapes of the transducer(s) and components and features thereof as shown in the FIGURES included herein can be merely illustrative of such physical attributes of these components. That is, these proportions, shapes and sizes can be modified according to various implementations to fit a variety of products. For example, while a substantially circular-shaped loudspeaker may be shown according to particular implementations, it is understood that the loudspeaker could also take on other three-dimensional shapes in order to provide acoustic functions described herein.

In various implementations, components described as being "coupled" to one another can be joined along one or more interfaces. In some implementations, these interfaces can include junctions between distinct components, and in other cases, these interfaces can include a solidly and/or integrally formed interconnection. That is, in some cases, components that are "coupled" to one another can be simultaneously formed to define a single continuous member. However, in other implementations, these coupled components can be formed as separate members and be subsequently joined through known processes (e.g., soldering, fastening, ultrasonic welding, bonding). In various implementations, electronic components described as being "coupled" can be linked via conventional hard-wired and/or wireless means such that these electronic components can communicate data with one another. Additionally, sub-components within a given component can be considered to be linked via conventional pathways, which may not necessarily be illustrated.

A number of implementations have been described. Nevertheless, it will be understood that additional modifications may be made without departing from the scope of the inventive concepts described herein, and, accordingly, other implementations are within the scope of the following claims.

What is claimed is:

1. An electro-acoustic transducer comprising:

a diaphragm configured to move along an axis;

a voice coil comprising a plurality of windings around the axis;

a voice coil support configured to transfer forces from the voice coil to the diaphragm;

a support structure that inhibits radial motion or tilting motion of the diaphragm and the voice coil support; and a magnetic core for driving the voice coil, the magnetic core comprising:

two magnets having opposite polarity and approximately equal magnetic strength, wherein each of the magnets surrounds the voice coil, wherein a magnetic field from each magnet is approximately symmetric along the axis, and wherein the magnetic field from both magnets drives the voice coil.

2. The electro-acoustic transducer of claim 1, wherein the magnetic core comprises:

a metal core section;

an upper metal layer;

a middle metal layer; and a lower metal layer, wherein a first one of the magnets is located between the upper metal layer and the middle metal layer, and wherein a second one of the magnets is located between the middle metal layer and the lower metal layer.

3. The electro-acoustic transducer of claim 2, wherein the two magnets each wrap around the metal core section, and wherein either:

a) the upper metal layer comprises at least two sub-layers over an upper one of the two magnets, or b) the lower metal layer comprises at least two sub-layers under a lower one of the two magnets.

4. The electro-acoustic transducer of claim 2, wherein the upper metal layer includes at least two sub-layers over an upper one of the two magnets and wherein the lower metal layer comprises at least two sub-layers under a lower one of the two magnets.

5. The electro-acoustic transducer of claim 2, wherein the metal core section is physically distinct from the upper metal layer and the lower metal layer.

6. The electro-acoustic transducer of claim 2, wherein the support structure is located between the magnetic core and the diaphragm, and wherein the lower metal layer is located directly under the second magnet and seals an acoustic volume behind the support structure.

7. The electro-acoustic transducer of claim 2, wherein the metal core section comprises distinct sub-sections, and wherein an upper sub-section is unitary with the upper metal layer and a lower sub-section is unitary with the lower metal layer.

8. The electro-acoustic transducer of claim 7, wherein the upper sub-section and the lower sub-section comprise steel.

9. The electro-acoustic transducer of claim 1, further comprising:

an additional diaphragm configured to move along the axis;

an additional voice coil comprising a plurality of windings around the axis; and an additional voice coil support configured to transfer forces from the additional voice coil to the additional diaphragm, wherein the magnetic core further comprises a third magnet having an opposite polarity from an adjacent one of the two magnets, wherein a magnetic field from the third magnet and the adjacent magnet drives the additional voice coil independently of the voice coil.

10. The electro-acoustic transducer of claim 1, wherein the two magnets are vertically stacked, wherein an upper magnet has one of a north-south polarity or a south-north polarity, and a lower magnet has the other of the north-south polarity or the south-north polarity, and wherein the voice coil is driven only by the magnetic field from the two magnets.

11. The electro-acoustic transducer of claim 1, wherein the magnetic core comprises at least one vertically oriented opening for accommodating the voice coil support.

12. The electro-acoustic transducer of claim 11, wherein the at least one vertically oriented opening comprises at least three vertically oriented openings extending through the magnetic core.

13. The electro-acoustic transducer of claim 1, wherein the support structure is located below the magnetic core on an opposite side of the magnetic core from the diaphragm.

14. The electro-acoustic transducer of claim 13, further comprising an additional support structure located above the magnetic core, between the magnetic core and the diaphragm.

15. An electro-acoustic transducer comprising:

a first diaphragm configured to move along an axis;

a voice coil comprising a plurality of windings around the axis;

a voice coil support configured to transfer forces from the voice coil to the first diaphragm;

a magnetic core for driving the voice coil, the magnetic core comprising:

a plurality of magnets each surrounding the voice coil, at least two of which have opposite polarity and at least two of which have approximately equal magnetic strength, wherein a magnetic field from each magnet in the plurality of magnets is approximately symmetric along the axis, and wherein the magnetic field from the at least two magnets drives the voice coil;

a support structure that inhibits radial motion or tilting motion of the first diaphragm and the voice coil support;

an additional diaphragm configured to move along the axis;

an additional voice coil comprising a plurality of windings around the axis; and an additional voice coil support configured to transfer forces from the additional voice coil to the additional diaphragm, wherein the magnetic core further comprises a third magnet having an opposite polarity from an adjacent one of the two magnets, wherein a magnetic field from the third magnet and the adjacent magnet drives the additional voice coil independently of the voice coil.

16. The electro-acoustic transducer of claim 15, wherein the support structure is located below the magnetic core, on an opposite side of the magnetic core than the first diaphragm, wherein the magnetic core comprises a metal core section, and wherein each of the plurality of magnets wraps entirely around the metal core section.

17. An electro-acoustic transducer comprising:

a diaphragm configured to move along an axis;

a magnetic core for driving a voice coil, the magnetic core comprising:

two magnets having opposite polarity and approximately equal magnetic strength, wherein each of the magnets surrounds the voice coil or the voice coil surrounds each of the magnets, wherein a magnetic field from each magnet is approximately symmetric along the axis, and wherein the magnetic field from both magnets drives the voice coil, wherein the magnetic core further comprises: a metal core section; an upper metal layer; a middle metal layer; and a lower metal layer, wherein a first one of the magnets is located between the upper metal layer and the middle metal layer, and wherein a second one of the magnets is located between the middle metal layer and the lower metal layer, and wherein either: a) the upper metal layer comprises at least two sub-layers over an upper one of the two magnets, or b) the lower metal layer comprises at least two sub-layers under a lower one of the two magnets;

a voice coil support configured to transfer forces from the voice coil to the diaphragm; and a support structure that inhibits radial motion or tilting motion of the diaphragm and the voice coil support.

18. The electro-acoustic transducer of claim 17, wherein the support structure is located between the magnetic core and the diaphragm, and wherein a lower metal layer in the magnetic core is located directly under a lowermost one of the two magnets in the magnetic core and seals an acoustic volume behind the support structure.

19. The electro-acoustic transducer of claim 17, wherein the magnetic core comprises at least three vertically oriented openings for accommodating the voice coil support, wherein the support structure is located below the magnetic core on an opposite side of the magnetic core from the diaphragm, and wherein the electro-acoustic transducer further comprises an additional support structure located above the magnetic core, between the magnetic core and the diaphragm.

20. The electro-acoustic transducer of claim 1, wherein a change in the magnetic field strength due to a displacement of the voice coil in one direction along the axis is approximately equal to a change in field strength due to an equal displacement of the voice coil in a second, opposite direction along the axis.

* * * * *